US005482687A

United States Patent [19]

Taylor et al.

[11] Patent Number: 5,482,687

[45] Date of Patent: Jan. 9, 1996

[54] SEPARATION OF SODIUM-22 FROM IRRADIATED TARGETS

[75] Inventors: Wayne A. Taylor; David Jamriska, both of Los Alamos, N.M.

[73] Assignee: The Regents of the University of California, Oakland, Calif.

[21] Appl. No.: 381,672

[22] Filed: Jan. 31, 1995

[51] Int. Cl.[6] ..... C01G 57/00

[52] U.S. Cl. ..... 423/2; 423/249; 423/179; 423/202; 376/195

[58] Field of Search ..... 376/195; 423/2, 423/184, 179, 202, 249

[56] References Cited

U.S. PATENT DOCUMENTS

| | | | |
|---|---|---|---|
| 3,399,030 | 8/1968 | Aubertin et al. | 423/2 |
| 4,894,208 | 1/1990 | Griffin et al. | 423/2 |

OTHER PUBLICATIONS

71–Nuclear Technology, vol. 108, 1988, 228204d.
71–Nuclear Technology, vol. 108, 1988, 139394y.
Chemical Abstracts, vol. 95, 1981, 140,520f.
Mitsuo Abe, "Synthetic Inorganic Ion–Exchange Materials." Separation Science and Technology, 15(1), pp. 23–30, 1980.
Konecny et al., "Studies on the Sodium (Cesium, Strontium)–Polyantimonic(V) Acid Ion Exchange equilibria In Dilute Nitric Acid Solutions." Z. phys. Chemie. Leipzig 256 (1975) 1,S. 17–25.
Caletka et al., "Removal of Sodium from Mineral Acid Solutions by Adsorption on Modified Polyanitomic(v) Acid Ion–Exchanger." Journal of Radioanalytical Chemistry, vol. 10 (1972) 5–15.
Girardi et al., "Selective Removal of Radio–sodium from Neutron–Activated Materials by Retention on Hydrated Antimony Pentoxide." Journal of Radioanalytical Chemistry vol. 1 (1968) 169–178.
Ralston, "Sodium Removal as an Aid to Neutron Activation Analysis." Analytical Chemistry, vol. 43, No. 1. Jan. 1971.
Gill et al. "Determination of Trace Elements in Galss by Activation Analysis Using Hydrated Antimony Pentoxide for Sodium Removal." Analytical Chemistry, vol. 42, No. 14, Dec. 1970.
Krishnan et al, "Sodium Removal by Hydrated Antimony Pentoxide in Neutron Activation Analysis." Radiochem. Radioanal. Letters 20/4–5/279–287/1975.

*Primary Examiner*—Ngoclan Mai
*Attorney, Agent, or Firm*—Bruce H. Cottrell; William A. Eklund

[57] ABSTRACT

A process for selective separation of sodium-22 from an irradiated target including dissolving an irradiated target to form a first solution, contacting the first solution with hydrated antimony pentoxide to selectively separate sodium-22 from the first solution, separating the hydrated antimony pentoxide including the separated sodium-22 from the first solution, dissolving the hydrated antimony pentoxide including the separated sodium-22 in a mineral acid to form a second solution, and, separating the antimony from the sodium-22 in the second solution.

10 Claims, No Drawings

SEPARATION OF SODIUM-22 FROM IRRADIATED TARGETS

FIELD OF THE INVENTION

The present invention relates to the field of selective separation of radioisotopes. More particularly, the present invention relates to the selective separation of sodium-22 from an irradiated target. This invention is the result of a contract with the Department of Energy (Contract No. W-7405-ENG-36).

BACKGROUND OF THE INVENTION

Sodium-22 is well suited as a radioactive tracer due to its relatively long half life (about 2.6 years) and its strong gamma ray emission (about 1275 KeV) with 99.9 percent abundance. Its uses as a radioactive tracer are principally in biological and geological fields, e.g., as a radioactive tracer for logging data in subterranean formations such as oil wells. Additionally, sodium-22 can be used in positron sources .

Proton irradiation of targets for radioisotope production is a common process. Often, in the proton irradiation of, e.g., molybdenum or rubidium bromide, the target material is encapsulated in aluminum or an aluminum alloy. The irradiation of the aluminum in such encapsulation material results in the production of sodium-22. Other metals can also be irradiated to yield sodium-22 but there has generally been no practical method of selectively separating the sodium-22 from the mixture of materials.

U.S. Pat. No. 4,894,208 describes a distillation process of separating sodium-22 from aluminum, a process which is vastly different from the presently described process. Additionally, it is described that the distillation process requires the use of a graphite cup as molten aluminum forms alloys from which sodium does not distill.

It is an object of the present invention to provide a process of separating sodium-22 from an irradiated target.

It is a further object of the present invention to provide a process of separating sodium-22 having a high specific activity from an irradiated target.

SUMMARY OF THE INVENTION

To achieve the foregoing and other objects, and in accordance with the purposes of the present invention, as embodied and broadly described herein, the present invention provides a process for selective separation of sodium-22 from an irradiated target including dissolving an irradiated target to form a first solution, contacting said first solution with hydrated antimony pentoxide to selectively separate sodium-22 from said solution, separating said antimony pentoxide including said separated sodium-22 from said first solution, dissolving said antimony pentoxide including said separated sodium-22 in a mineral acid to form a second solution, and, separating said antimony from said sodium-22 in said second solution.

DETAILED DESCRIPTION

The present invention is concerned with a process for the selective separation of sodium-22 from a previously irradiated target. Such an irradiated target can be, e.g., an irradiated metal, metal oxide or metal salt. Sodium-22 is an irradiation product commonly found from many irradiation processes. Accordingly, much sodium-22 is present in irradiation processes used to produce other radioisotopes and such sodium-22 has often gone unrecovered for lack of a convenient separation process. The separation process of the present invention can readily and conveniently produce up to curie quantities of sodium-22 for use in the field of nuclear chemistry, e.g., as a radioactive tracer.

As mentioned, numerous materials are suitable as the target initially irradiated to yield the sodium-22. Many metals, metal oxides or metal salts yield sodium-22 upon irradiation. Among the metals especially suitable for irradiation are included aluminum, magnesium, manganese, molybdenum with aluminum being especially preferred. Metal oxides of any suitable metal, e.g., magnesium oxide and aluminum oxide and the like, are also suitable for the production of sodium-22 by irradiation. Also, metal salts such as, e.g., aluminum chloride and the like, are suitable for the production of sodium-22 by irradiation.

In the present process, a suitable target such as an aluminum target is initially irradiated. One method of irradiation is by proton bombardment of the target. Such proton bombardment can be accomplished by inserting the target into a linear accelerator beam at a suitable location whereby the target is irradiated at an integrated beam intensity of from about 30 milliampere-hours (mA-hr) to about 1000 mA-hr. For proton bombardment, energetic protons having energies sufficient to generate a large number of isotopes by spallation reactions are needed, generally energies greater than about 200 MeV, more preferably from about 600 MeV, to about 800 MeV. Other irradiation techniques that yield sodium-22 by processes other than by spallation can also be used. Among other suitable irradiation processes can be those involving triton and deuteron. In order to produce the desired millicurie to curie quantities of the radioisotopes, the particular target should generally have a weight of at least about 100 grams (g).

Aluminum, or more usually an aluminum alloy, has often been used as an encapsulation material for other materials subjected to such a high energy irradiation process. The aluminum or aluminum alloy material used in encapsulating other target materials can be used in the recovery or selective separation of sodium-22 without the need for a separate aluminum target. Aluminum alloys used in encapsulating other target materials often include alloying materials such as copper, zinc, iron, vanadium and the like.

In the selective separation of the present invention, the irradiated target is initially dissolved by a suitable acid, e.g., hydrochloric acid, nitric acid, sulfuric acid, or phorphoric acid by either a batch or continuous process. Preferably, the dissolving acid is hydrochloric acid or nitric acid and the dissolution is by a batch process. More preferably, the acid is hydrochloric acid. The hydrochloric acid solution can be of any convenient concentration although solution concentrations of greater than about 6 Molar hydrochloric acid are preferred for quicker dissolution.

The resulting solution from the dissolution is next contacted with hydrated antimony pentoxide. By "hydrated antimony pentoxide", it is meant to include those antimony oxide species capable of selectively separating and strongly binding essentially all of the sodium within the solution, such species including and sometimes referred to as hydrated antimony pentoxide, crystalline antimony pentoxide, antimonic anhydride, antimonic acid, antimony (V) acid, polyantimonic (V) acid, and polyantimonic acid. A suitable antimony oxide material can be formed by mixing antimony chloride with water. The solution can be contacted in a batch process or can be passed through a column of the hydrated antimony pentoxide. Generally, a column is preferred for ease of separation of the remaining solution and to minimize the total amount or volume of hydrated antimony pentoxide used. Minimization of the total amount of hydrated antimony pentoxide and other reagents used in the present process is generally preferred as other sodium isotopes are typical contaminants of almost all reagents. To avoid introduction of additional sodium, the dissolution stage should not be carried out in glassware, rather metal, quartz or plastic should be used.

After the solution is separated from the hydrated antimony pentoxide, the hydrated antimony pentoxide with the separated sodium is dissolved, e.g., in a strong acid such as HCl to form a solution. This dissolution of the hydrated antimony pentoxide is preferably conducted under elevated temperatures (about 150° C.) and pressures. Such dissolution can be conveniently carried out in, e.g., a Parr bomb. It is generally desirable to minimize the amount of acid used in this step to minimize the addition of other sodium isotopes.

The solution containing the dissolved hydrated antimony pentoxide with the separated sodium is then subjected to a reductive step. In this reductive step the antimony is reduced to a stage whereat it is removable by filtration or the like thereby leaving a solution of sodium-22 chloride. One preferred reductive step for reduction of the antimony is by electrochemical reduction. This is accomplished by placing the dissolved hydrated antimony pentoxide with the separated sodium in an electrolytic cell and passing an appropriate current, e.g., from about 1 to about 30 amperes under a potential of, e.g., from about 0.1 volt to about 10 volts. Typically, any current and potential may be used that allow the electrolysis to take place. In another manner a reductant or metal capable of reducing the antimony can be added to the solution in a sufficient amount to substantially reduce the antimony so that it may be removed from the solution. The reductant metal can be, e.g., zinc, aluminum and the like, preferably zinc. The zinc can then be separated from the sodium-22 by use of an appropriate ion exchange resin, either cation exchange resin or anion exchange resin.

Although the substantial majority of the antimony is removed in the electrolysis, some minor amount of antimony can remain. This can be removed by passing the solution recovered after electrolysis through an anion exchange resin in, e.g., a suitable column. Among the suitable anion exchange resins to remove the traces of antimony is AG1X8 available from BioRad.

After the last traces of antimony are removed the remainder solution is essentially pure sodium-22 with a specific activity generally within the range of from about 1000 to 2000 Curies per gram (Ci/g).

The present invention is more particularly described in the following example which is intended as illustrative only, since numerous modifications and variations will be apparent to those skilled in the art.

EXAMPLE

An irradiated aluminum target was dissolved in concentrated hydrochloric acid as sufficient water was added to cool and control the reaction. The resultant solution was then filtered to remove and heated to dissolve any remaining residues. The remaining solution was then passed through a 1.2 mL column of hydrated antimony pentoxide (from Aldrich Chemical Co.) followed by washing or rinsing the column with 50 mL of 1 Molar (M) hydrochloric acid. The hydrated antimony pentoxide was then transferred to a Parr Bomb with 30 mL of concentrated hydrochloric acid and heated at about 150 ° C. for four hours to dissolve the hydrated antimony pentoxide. After cooling, the total solution volume was reduced by evaporation to better fit into an electrolytic cell. This also had the benefit of changing the acid concentration to 6M. The resulting solution was placed in an electrolytic cell and a current of between 5 and 10 amperes with a potential of from 2 to 4 volts was passed through the cell using platinum electrodes and periodic stirring. After 6 hours, the current was turned off and the relatively neutral solution was filtered. Finally, sufficient HCl was added to convert the remaining solution to about 4M HCl and passed through a 15 mL AG1X8 anion exchange column to remove any remaining traces of antimony. At this point, a pure sodium fraction existed which was taken to dryness and then brought up in a small volume of 0.1M HCl.

Although the present invention has been described with reference to specific details, it is not intended that such details should be regarded as limitations upon the scope of the invention, except as and to the extent that they are included in the accompanying claims.

What is claimed is:

1. A process for selective separation of sodium-22 from an irradiated target comprising:

dissolving an irradiated target to form a first solution;

contacting said first solution with hydrated antimony pentoxide to selectively separate sodium-22 from said solution;

separating said antimony pentoxide including said separated sodium-22 from said first solution;

dissolving said antimony pentoxide including said separated sodium-22 in mineral acid to form a second solution; and, separating said antimony from said sodium-22 in said second solution.

2. The process of claim 1 wherein said separating of said antimony from said sodium-22 in said second solution comprises electrochemically reducing a substantial portion of said antimony.

3. The process of claim 1 wherein said target is a metal selected from the group consisting of aluminum, magnesium, manganese, and molybdenum.

4. The process of claim 1 wherein said mineral acid is concentrated hydrochloric acid.

5. The process of claim 1 wherein said separating of said antimony from said sodium-22 in said second solution comprises adding a metal capable of reducing a substantial portion of said antimony in said solution; and, contacting said solution with an ion exchange material to separate said sodium from other metal ions within said solution.

6. The process of claim 1 wherein said contacting said first solution with hydrated antimony pentoxide and said separating said antimony pentoxide including said separated sodium-22 are conducted in a single step by passing said first solution through a column of hydrated antimony pentoxide.

7. The process of claim 5 wherein said metal capable of reducing said antimony is zinc.

8. The process of claim 1 wherein said target is aluminum.

9. The process of claim 1 wherein said target is selected from the group consisting of metals, metal oxides and metal salts capable of producing sodium-22 upon irradiation.

10. The process of claim 3 wherein said target is aluminum.

* * * * *